United States Patent [19]

Roberts et al.

[11] 4,264,019

[45] Apr. 28, 1981

[54] BEVERAGE DISPENSER

[75] Inventors: Robert O. Roberts, Tallmadge; David A. Weitzenhof, Bath, both of Ohio

[73] Assignee: The Firestone Tire & Rubber Company, Akron, Ohio

[21] Appl. No.: 67,640

[22] Filed: Aug. 17, 1979

[51] Int. Cl.[3] ..... B65D 35/28

[52] U.S. Cl. ..... 222/95; 222/105; 222/107; 222/325

[58] Field of Search ..... 222/325, 326, 327, 105, 222/95, 107, 399, 386.5, 146 C; 62/389, 394, 395

[56] References Cited

U.S. PATENT DOCUMENTS

| | | | |
|---|---|---|---|
| 659,895 | 10/1900 | Peters | 222/399 |
| 2,564,163 | 8/1951 | Leperre | 222/95 X |
| 4,048,994 | 9/1977 | Lo | 222/95 X |
| 4,090,514 | 5/1978 | Hinck | 222/95 X |

*Primary Examiner*—Allen N. Knowles

[57] ABSTRACT

A storage and dispensing device for bulk carbonated beverages, for home use, comprising a two-part unit, a carrier portion providing support as well as a pressure medium and pressure means, and a separate cartridge unit containing the beverage to be dispensed through a beverage outlet; the cartridge is adapted to be removably nested with, and pressurized from, the carrier, while the beverage is self-pressurized from its carbonation.

11 Claims, 5 Drawing Figures

FIG. 4
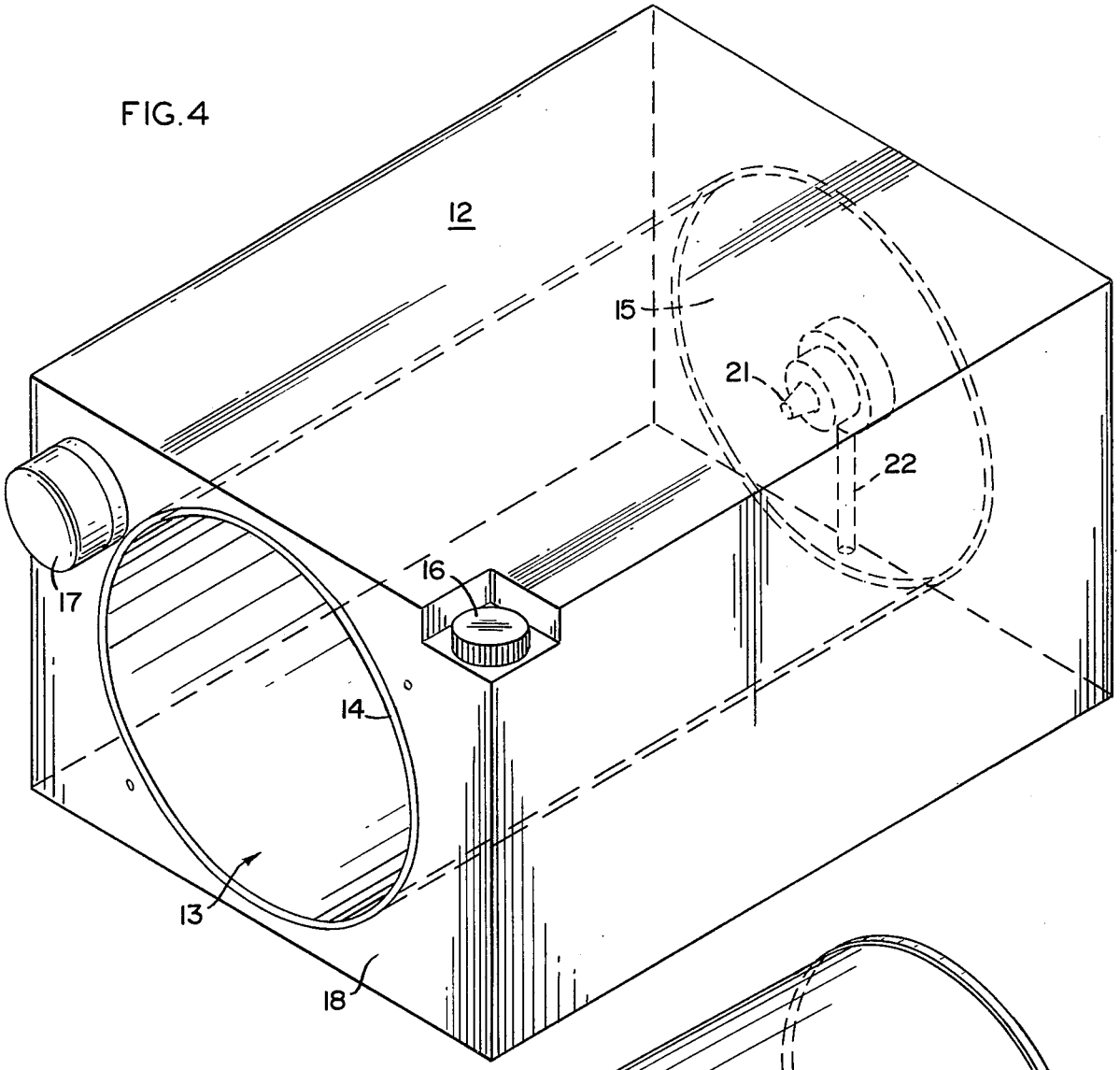
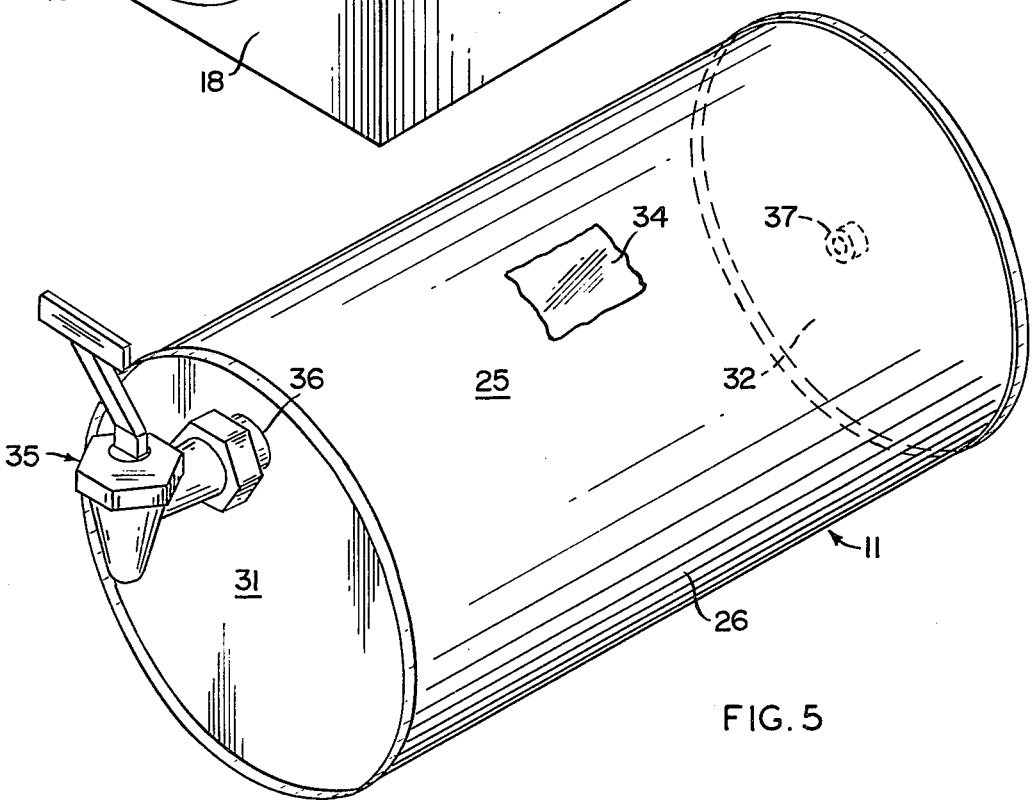
FIG. 5

BEVERAGE DISPENSER

BACKGROUND OF THE INVENTION

Beer in the keg, as well as other gassed products, will contain a substantial amount of gas, such as carbon dioxide, dissolved in the liquid; this liquid is kept under pressure, for two main reasons: in order to enable withdrawal from the keg; and to keep the carbon dioxide from escaping or outgassing upon such withdrawal, leaving the liquid "flat".

When carbonated beverages are handled commercially, in taverns or restaurants, pressure for dispensing and pressurizing is supplied through pressure-regulated tanks of gas, a system whose complexity and size do not make it useful or economical for home dispensing.

Systems for home storage and dispensing of larger quantities of beverage than convenient through bottles or cans have been suggested in the past, including some which keep the pressurizing medium separated from the beverage so as not to contaminate or spoil it.

One such approach may be considered as a structure which encompases the beverage container, the pressurizing means, and the pressurizing medium, all in one inseparable, cumbersome unit. The following classifies variations within the type just described. An early patent to Byrne, U.S. Pat. No. 50,085 of 1865, suggests the basic use of a bag-within-a-box, in which the beverage bag is pressurized by the weight of a sliding lid. Douglas U.S. Pat. No. 3,057,517 (1962) fixes his flexible beverage bag in the container and then pressurizes it with contained water. The later U.S. Pat. No. 3,294,289 to Bayne (1966), suggests the use of two flexible bags fixed within a single container, one pressurized with air to act on the exterior of a beverage bag or, alternatively, within the beverage bag. The latter approach was preceded by the Fleming U.S. Pat. No. 78,447 (1868) in which the pressurizing bag is in the beverage, which is itself in direct contact with the container.

Since the home-dispensing units are to be adjuncts to the home-refrigerator, they must be scaled in size and weight for ease of handling, and should easily accommodate bulk-beer in its handiest form, i.e., in refillable or disposable containers. Thus, the above-mentioned beverage bags, sealed to their various containers and thus tied to pressure reservoirs and pressurizing means, comprise cumbersome, unitary devices which could hardly be accommodated in the home-refrigerator, and in which beverage container replacement would be time- and effort-consuming.

Accordingly, it is an object of the present invention to provide a beverage storage- and dispensing-system for home-refrigerator use, wherein the beverage container may be continuously pressurized by a base-unit for dispensing and to prevent 'outgassing' during use, yet is easily replaceable without disturbing the installation of the basic system. This is accomplished without compressed gases, pressure regulators, or high pressures.

SUMMARY OF THE INVENTION

The invention relates to a two-part home beverage storage and dispensing system, wherein a carrier portion, placeable within a refrigerator contains a pressurizing medium as well as a means to apply pressure to the beverage, which is contained in a separate cartridge portion.

The invention deals specifically with the problem of outgassing of, for example, carbonation from a bulk beverage such as beer or soft drinks, after removal of some of the original full volume of the carbonated product.

The cartridge portion preferably comprises a closed rigid cylindrical tube supporting a flexible bag for containing the beverage. Access to the beverage is through a front end plate of the tube, in which a tap is located.

The carrier portion comprises a rigid case adapted to contain water, and having a recessed well to receive the beverage-filled cartridge. As the cartridge is nested with the carrier, a receiver in the rear wall of the cartridge automatically engages with a check valve member on the carrier, to provide a one-way flow means between the interior of the carrier and the interior of the cartridge tube. A hand air-pump creates a slight positive pressure in the carrier. Opening the tap first relieves any excess built-up carbonation pressure in the beverage bag and then allows water to flow from the carrier through the check valve into the cartridge tube behind the bag. This sustains a slight positive pressure on the outside of the bag, forcing out first any gas volume and then the beverage through the tap. When the tap is again closed, water will stop flowing, the check valve will prevent reverse water flow, and the carbonation pressure will start to build again.

As the beverage volume decreases, the reduced volume inside the cartridge tube is backfilled by water introduced against the bag-exterior by operating the hand-pump. This prevents outgassing, since the bag cannot expand against the incompressible water behind it, and the water cannot retreat out of the cartridge because of the check valve. The beverage will continue to be dispensed so long as a slight pressure is available to push it out. When all the beverage has been dispensed, the carrier will be empty, the cartridge tube substantially totally filled with water, and the flexible bag crushed flat upon itself.

BRIEF DESCRIPTION OF THE DRAWINGS

Further objects of the invention will appear by reference to the accompanying drawings in which:

FIG. 4 is an isometric view of the carrier only, while FIG. 5 is a similar view, showing only the cartridge.

DESCRIPTION OF PREFERRED EMBODIMENTS

Figure 1:
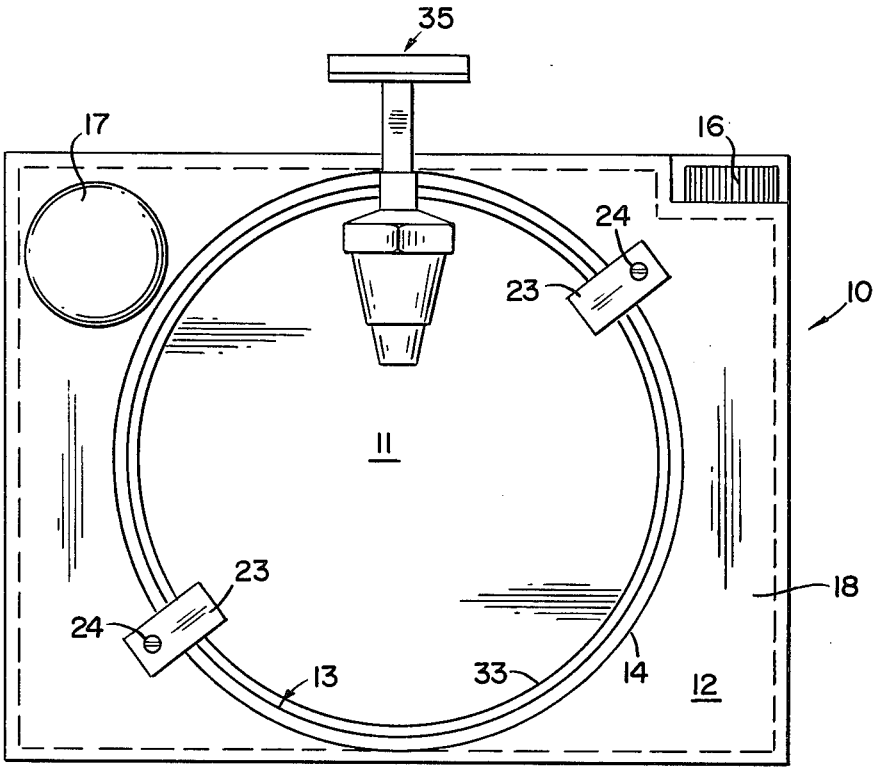
FIG. 1 is a front elevation of the dispensing device, showing carrier and cartridge in nested condition.
Figure 2:
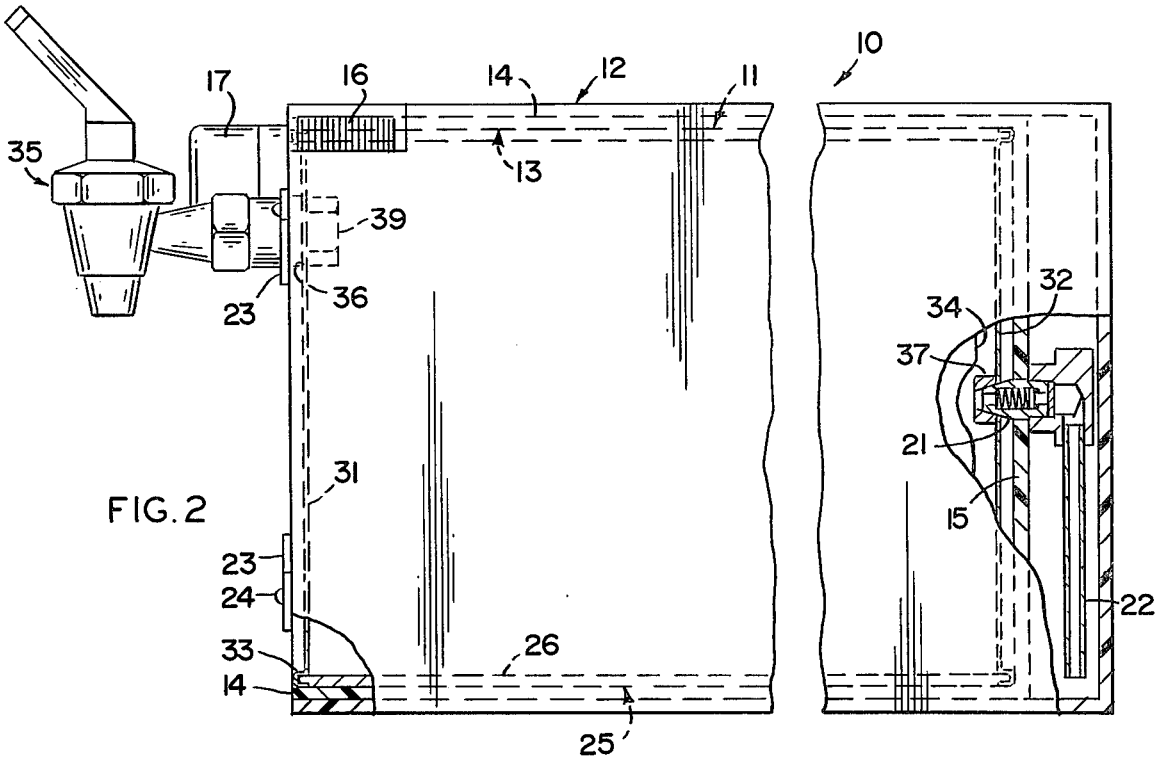
FIGS. 2 and 3 are side and top elevations, respectively, similar to FIG. 1, portions of FIG. 2 being in section.
Figure 3:
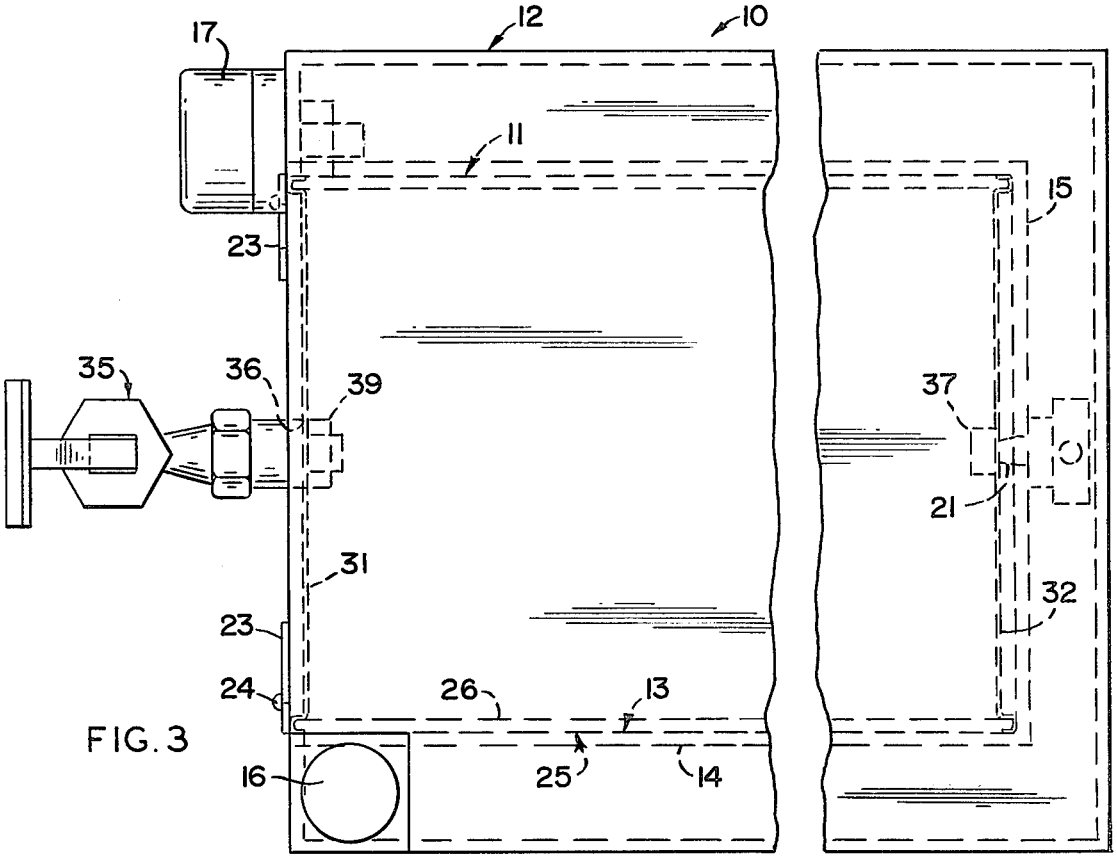

Referring to FIGS. 1–3, the dispensing system 10 is seen therein in its operative condition, wherein cartridge unit 11 is nested within carrier 12.

Turning first to the carrier 12, see also FIG. 4, this is basically a water-tight, rectangular first liquid reservoir or box having a longitudinally extending recessed cavity or well 13 defined by a cylindrical wall 14 and an end wall 15 spaced from the rear of the box. The carrier has a port 16, through which an incompressible medium, such as water, is filled.

Slight air pressure may be exerted on the water within the carrier by means of a hand airpump 17 located on front wall 18.

In the rear end wall 15 of the well 13 is affixed a one-way valve 21, together with its associated dip-tube 22 extending toward the floor of the carrier, whose details are seen most clearly in FIG. 2. The valve 21 allows fluid-flow from the carrier in the direction of the well 13, but not back into the carrier, for purposes hereinafter explained.

Also on the front carrier wall are located a number of dogs 23, held and pivoted as at 24, in order to maintain the carrier 12 and the cartridge 11 together in nesting condition, as best shown in FIGS. 1–3.

The cartridge or second liquid reservoir 11 comprises a rigid support member in the form of tube 25 having a cylindrical wall 26 and having end walls 31 and 32, which may be in the form of metal sheets crimped over the cylindrical wall 26 as at 33.

Within the tube 25 is located a flexible beverage-bag 34, impermeable to liquid and to pressurizing gases such as carbon dioxide. The bag is completely closed but, when filled, the beverage therein is accessible by a tapping device 35 inserted through an opening 36 reinforced as by insert 39 in the front wall 31 and thus into communication with interior of the bag. This may be accomplished by initially sealing the bag along opening 36 and providing a protective cover or skin until the tap 35 is threaded into place.

Since it is anticipated that the cartridge will be supplied to the carrier as refillable or throw-away, the structure of the cartridge-tube 25 must be such as to provide sufficient strength for storage, handling and against bursting when beverage under carbonation-pressure fills the bag 34.

The rear wall 32 of the cartridge is provided with an apertured female check valve receiver 37 situated to mate snugly with check valve 21 when the cartridge 11 is nested completely within the well 13.

With the cartridge 11 and its flexible bag 34 filled with carbonated beverage placed in the carrier 12; with valve 21 snugly seated; with water in the carrier in an amount substantially equal to the volume of beverage; with the tap 35 in place, the home dispenser is ready for use, as follows: A few light strokes of the hand-pump pressurizes the water in the carrier. When the tap 35 is opened, water flows through dip tube 22, valve 21 and receiver 37 into the space 38 behind the bag 34 in tube 25. This water pressure on the outside of the bag forces the beverage out of the tap, until the tap is again closed.

By means of the hand-pump, water continues to fill the space created behind the bag as beverage is withdrawn; since it is incompressible, and is prevented from returning to the carrier by the check valve 21, the water maintains a continuous pressure on the beverage, thus also preventing carbon dioxide from leaving the beverage.

When the bag has been emptied of beverage, the cartridge, its tube now full of water, may be removed from the carrier, now substantially empty of water, and replaced. If the carrier should contain remaining water after the cartridge has been completely filled, the pressure may, of course, be relieved by appropriately venting the hand-pump 17 or the port 16, so as to prevent water from exiting the one-way valve 21 after it and the receiver 37 have been separated in removing the cartridge.

The pressure exerted by a typical carbonated beverage on its container may be about 2.8 kg per square cm at elevated summer storage temperatures. These substantial pressures must be taken into consideration when constructing the cartridge 11. The flexible bag 34 is designed to be slightly larger than the tube 25, so that it will fit snugly against the tube walls, but without stretching unduly. Carbonated beverages may contain carbon dioxide in amounts ranging up to 4 volumes per volume of beverage. As stated earlier, the bag 34 is therefore constructed to be impervious to carbon dioxide gas.

The tube 25 is typically constructed of cardboard having a wall gauge of, for example, 0.38 cm, and closed by coated steel ends 31 and 32. The tapping device 35 may be placed in the cartridge upon its being filled, or it may be inserted by the user, through a previously sealed or covered opening, immediately prior to the cartridge being nested into the carrier 12.

The carrier 12 is conveniently molded as a plastic, watertight case, suitable for placement into a refrigerator, and having an interior volume substantially equal to the full volume of beverage in the cartridge 11. In this manner, as the hand air-pump 17 applies a pressure of about 0.07 to 0.14 kg per square cm, the water in the carrier will entirely disperse the beverage and fill the volume of the cartridge, while simultaneously entirely emptying the carrier.

A useful disposable cartridge may contain about 4 liters of beverage in a cylindrical space approximately 26 cm long and 14 cm in diameter. This would be nested with a rectangular carrier about 29 cm long, 21 cm wide, and 16 cm high.

Whereas the bag 34 has been described above as being closed and sealed at the opening 36 in front wall 31, it may be constructed as an open bag which is sealed around the rim of the tube 25 at the same time the metal ends are crimped on.

The cartridge 11 and carrier 12, although shown nested, may of course, simply be engaged against each other so as to provide for the one-way fluid communication.

It will also be understood that the fluid interconnection between the carrier and the rear of the cartridge, rather than being a valve-means 21 and a receiver 37 which mate upon nesting of carrier and cartridge, may be made by manually completing a one-way valve connection from the carrier to the cartridge.

Additionally, the check valve may be located in the cartridge, rather than in the carrier; and could be in the form of a flap-valve.

Instead of placing the carrier into a refrigerator as an additional unit, such carrier may, of course, be molded to fit a specific space available in the refrigerator, thus in effect becoming integral with it. Alternatively, the refrigerator may itself supply the support structure for the cartridge, while the water supply normally found in modern ice-maker refrigerators is used, through a suitable pressure-reducer and flow-control, to supply water through a one-way valve, to the rear of the cartridge.

Although described in connection with the dispensing of carbonated beverages, the device herein may, of course, be used for the positive dispensing of non-carbonated beverages such as milk or fruit juices.

Other modifications will appear to those skilled in the art, without departing from the scope of the invention.

What is claimed is:

1. Beverage dispensing device comprising (a) a carrier adapted to contain a measured supply of water;

(b) a cartridge removably nesting with said carrier and comprising (1) a rigid tubular enclosure, (2) a flexible bag within said enclosure adapted to contain a volume of carbonated beverage substantially equal to said water supply, and
(3) a beverage tap;
(c) pump means to pressurize said water; and
(d) one way valve means to transfer said water from said carrier to said cartridge upon activation of said pump means.

2. Dispensing and storage device for a carbonated beverage comprising
(a) a carrier comprising
(1) a reservoir containing a measured water supply,
(2) a hand-pump on said reservoir to pressurize said water, and
(3) a one-way valve providing egress from said reservoir;
(b) a closed cartridge removably nested within a recessed well in said carrier and comprising
(1) a rigid cylindrical support tube,
(2) a flexible bag, impervious to carbon dioxide, enclosed within said tube and containing an initial volume of carbonated beverage substantially equal to that of said water supply,
(3) a tap in the wall of said tube communicating with said beverage, and
(4) receiving means in said tube and cooperating with said valve to provide ingress for water to said tube;
said water exerting collapsing pressure on said bag to assist in dispensing beverage, and to prevent outgassing of carbon dioxide therefrom.

3. Beverage dispensing device comprising
(a) a carrier adapted to contain a pressurizing medium and having means to pressurize said medium;
(b) a cartridge removably located in a cavity in said carrier, having a flexible bag with dispensing means, and adapted to contain a beverage; and
(c) means separably interconnecting said carrier and said cartridge to provide passage for the medium to pressurize said bag.

4. A carrier for use in a beverage dispensing device comprising
(a) a reservoir adapted to contain a measured volume of water, said reservoir having an exterior forming a well adapted to receive, in removable nesting relationship, a self-contained beverage cartridge whose volume substantially equals that of the water,
(b) a filler-means on said reservoir to admit water therein,
(c) a dip-tube in said reservoir,
(d) a one-way valve in said well and communicating with said dip-tube, said valve adapted to cooperate with receiving means in the cartridge to conduct water between it and said carrier, and
(e) a pump on said reservoir to pressurize the water and move substantially all of it from said carrier through said valve into the cartridge.

5. A carrier for use in a beverage dispensing device comprising
(a) a reservoir adapted to contain an incompressible fluid, said reservoir having an exterior forming a well adapted to receive a beverage cartridge in removable, nesting relationship,
(b) filler-means on said reservoir to admit fluid therein,
(c) one-way valve means in said well adapted to cooperate with receiving means in the cartridge to conduct fluid between it and said carrier, and
(d) pump-means on said reservoir to pressurize the fluid and move it from said carrier through said valve means into the cartridge.

6. A carrier for use in a beverage dispensing device comprising
(a) a fluid reservoir having an exterior wall recessed to receive a removable beverage cartridge,
(b) means to fill said reservoir with an incompressible fluid,
(c) one-way valve means in said wall adapted to cooperate with receiving means in the cartridge to conduct liquid between it and said carrier, and
(d) pump-means on said reservoir to pressurize the fluid and move it from said carrier through said valve means into the cartridge.

7. A carrier for use in a beverage dispensing device comprising
(a) a reservoir adapted to contain an incompressible medium, said reservoir having an exterior wall adapted to cooperate with an adjacent separate, removable beverage cartridge,
(b) first means in said exterior wall adapted to cooperate with receiving means in the removable cartridge to conduct medium between it and said carrier, and
(c) second means on said reservoir to move the medium from said carrier through said first means into the removable cartridge.

8. Beverage dispensing device comprising
(a) a carrier adapted to contain a pressurizing medium;
(b) a cartridge removably nested with said carrier and comprising
(1) a rigid enclosure,
(2) a flexible bag within said enclosure adapted to contain a carbonated beverage, and
(3) beverage dispensing means;
(c) means to pressurize said medium; and
(d) communication means to transfer said medium from said carrier to said cartridge upon activation of said pressurizing means.

9. Beverage dispensing device as in claim 8, wherein said communication means comprises one-way valve means.

10. Beverage dispensing device as in claim 8, wherein said communication means comprises a one-way valve in said carrier and a receiver therefor in said cartridge.

11. Beverage dispensing device as in claim 8, wherein said pressurizing means comprises a hand-pump on said carrier.

* * * * *